US005586443A

United States Patent [19]

Lewis

[11] Patent Number: 5,586,443

[45] Date of Patent: Dec. 24, 1996

[54] REFRIGERANT CONSERVATION SYSTEM AND METHOD

[75] Inventor: Gordon A. C. Lewis, Ronkonkoma, N.Y.

[73] Assignee: Conair Corporation, Garden City Park, N.Y.

[21] Appl. No.: 530,961

[22] Filed: Sep. 20, 1995

[51] Int. Cl.[6] ..... F25B 1/00

[52] U.S. Cl. ..... 62/115; 62/174; 62/228.3

[58] Field of Search ..... 62/174, 175, 228.1, 62/228.3, 149, 115, 56

[56] References Cited

U.S. PATENT DOCUMENTS

| | | | |
|---|---|---|---|
| 1,703,299 | 2/1929 | Copeman . | |
| 1,815,962 | 7/1931 | Andrews . | |
| 3,238,737 | 3/1966 | Shrader et al. . | |
| 3,400,552 | 9/1968 | Johnson et al. . | |
| 3,736,763 | 6/1973 | Garland . | |
| 3,903,709 | 9/1975 | Anderson et al. . | |
| 4,562,700 | 1/1986 | Atsumi et al. | 62/174 |
| 4,653,286 | 3/1987 | Huenniger | 62/174 |
| 5,186,017 | 2/1993 | Hancock et al. . | |
| 5,259,204 | 11/1993 | McKeown . | |
| 5,319,945 | 6/1994 | Bartlett . | |
| 5,333,468 | 8/1994 | Rice . | |
| 5,359,863 | 11/1994 | Lewis . | |
| 5,361,592 | 11/1994 | Lewis . | |
| 5,379,604 | 1/1995 | Furr . | |
| 5,379,607 | 1/1995 | Sergius . | |
| 5,381,669 | 1/1995 | Bahel et al. . | |
| 5,392,610 | 2/1995 | Nelson et al. . | |
| 5,396,774 | 3/1995 | Hubbell, Jr. . | |
| 5,398,518 | 3/1995 | Veer . | |
| 5,400,606 | 3/1995 | Scuderi . | |
| 5,400,611 | 3/1995 | Takeda et al. . | |
| 5,406,806 | 4/1995 | Ricketts et al. . | |
| 5,408,840 | 4/1995 | Talley . | |
| 5,415,014 | 5/1995 | Waldschmidt et al. . | |
| 5,423,190 | 6/1995 | Friedland . | |
| 5,425,244 | 6/1995 | Vaynberg . | |
| 5,433,087 | 7/1995 | Locatelli . | |
| 5,435,145 | 7/1995 | Jaster . | |
| 5,435,149 | 7/1995 | Strong et al. . | |
| 5,438,841 | 8/1995 | Cahill-O'Brien et al. . | |
| 5,440,891 | 8/1995 | Hindmon, Jr. et al. . | |
| 5,440,894 | 8/1995 | Schaeffer et al. . | |
| 5,440,896 | 8/1995 | Maier-Laxhuber et al. . | |
| 5,442,930 | 8/1995 | Stieferman . | |
| 5,454,229 | 10/1995 | Hanson et al. . | |
| 5,454,230 | 10/1995 | Janke et al. . | |
| 5,456,087 | 10/1995 | Szynal et al. . | |
| 5,460,006 | 10/1995 | Torimitsu . | |
| 5,460,008 | 10/1995 | Ott et al. . | |
| 5,463,874 | 11/1995 | Farr . | |
| 5,471,848 | 12/1995 | Major et al. . | |
| 5,471,849 | 12/1995 | Bessler . | |
| 5,479,788 | 1/1996 | Roegner . | |
| 5,481,883 | 1/1996 | Harkness . | |
| 5,481,884 | 1/1996 | Scoccia . | |

FOREIGN PATENT DOCUMENTS

| | | |
|---|---|---|
| 250914 | 1/1988 | European Pat. Off. . |
| 404028967A | 1/1992 | Japan . |

*Primary Examiner*—John M. Sollecito
*Attorney, Agent, or Firm*—Fisher, Christen & Sabol

[57] ABSTRACT

The present invention provides a refrigerant conservation system and method for preventing the release of refrigerant to the atmosphere during high pressure system failure. Refrigerant is delivered from the refrigerant loop of the refrigerant system to an evacuated sealed receiver. The receiver tank may be retrofitted to the existing high pressure safety relief valve of a multiple compressor mechanical refrigeration system. When the pressure in the receiver tank exceeds a predetermined value, a pressure switch denies operating current to at least one of the compressors to prevent their operation and to contain refrigerant within a closed system which would otherwise be discharged into the atmosphere while allowing at least one of the compressors to operate. After a timed delay cycle, the refrigerant conservation system also recharges the contained refrigerant into the system and restarts the disabled compressors. If the system pressure exceeds the safe operating pressure by a substantial amount, another pressure switch denies operating current to all the compressors to shut down the entire system. Then, the system must be manually restarted.

20 Claims, 2 Drawing Sheets

REFRIGERANT CONSERVATION SYSTEM AND METHOD

FIELD OF THE INVENTION

The present invention relates to a method and apparatus for preventing the release of refrigerant to the atmosphere from a mechanical refrigeration system having a plurality of compressors.

BACKGROUND OF THE INVENTION

In conventional refrigeration systems, if pressure buildup within the system exceeds a predetermined value, a safety valve will open to release refrigerant to the atmosphere. This relieves pressures within the system and therefore avoids damage to the refrigeration system or an explosion which could cause property damage or injuries. A refrigeration system which employs a safety valve (23) which releases refrigerant to the atmosphere is disclosed in U.S. Pat. No. 1,703,299 to Copeman.

Conventional safety or relief valves are usually designed to vent overpressure in a system and then reseat when the system pressure returns to a value lower than the safety valve set point. Often, for various reasons such as age, infrequent use, contamination, or debris on the seat the safety valve does not properly reseat. This can cause the entire refrigerant charge to be vented from the system, which for large systems means a thousand pounds of refrigerant or more will be released to the atmosphere. Even when the safety valve properly reseats, a substantial portion of the refrigerant may be released to the atmosphere. Thus, in conventional systems, the potential for refrigerant release to the atmosphere exists regardless of whether the relief valve is operating properly.

Release of refrigerants to the atmosphere, while saving the equipment, unfortunately may contribute to pollution of the atmosphere. The U.S. and more than 80 other countries have reached a pact to halt the production of chlorofluorocarbons, or CFC's after 1995. The leading coolants slated for replacing CFC's in the next generation of industrial air conditioners, or chillers, are HFC 134*a* and HCFC 123. Even these CFC substitutes have been accused of exhibiting some global warming effect, or small ozone-depletion effect, or causing benign tumors in rats. CFC's may be used after the production deadline, but costs for the refrigerants will greatly increase as the supply decreases. CFC's have already increased from less than one dollar a pound ten years ago to over $7.00 per pound. It is estimated that the pool of CFC's after the ban on production will supply only about 25% of current needs.

Thus, there exists a great need for conserving refrigerant, whether it be the banned CFC's or their proposed replacements, both from an ecological view and from an economic one.

European patent no. 250,914 employs a valve 8 and a container 1 downstream of the valve to collect refrigerant and prevent the refrigerant from being released to the atmosphere during refrigerant draining.

Japanese patent no. 28,967 discloses an expansion tank 11 which communicates with the high pressure side of the refrigerant system via line 17. The tank is connected to the inlet of a compressor by a capillary tube 14 and a check valve 15. A valve is opened when a discharge pressure of the compressor exceeds a specified value. The valve actuator 13 is controlled by element 12 which in turn communicates with the discharge of the compressor 1.

U.S. Pat. No. 5,186,017 to Hancock et al employs tanks 16 (FIGS. 1 and 2) and 316 (FIGS. 6 to 8) to accept refrigerant from the high pressure side of the refrigerant system. Condition responsive controlled compressors 172 (FIG. 2) and 372 (FIGS. 6 to 8) return vapor from the tank to the refrigerant system.

U.S. Pat. No. 3,736,763 to Garland illustrates the employment of condition responsive control means (FIG. 2) to control a compressor motor 28 and valves 21, 37 and 39 in response to pressure switches 38 and 40 which communicate with receiver 16. The tank 33 located between valves 37 and 39 contains a non-condensable gas.

U.S. Pat. No. 3,238,737 to Schrader et al discloses (FIG. 2) a check valve 26 which releases refrigerant from liquid line 13A to a tank 17 (column 4, lines 27 to 53).

U.S. Pat. No. 1,815,962 to Andrews discloses a pressurized refrigerant container 40 to charge the refrigerant system. The patent also discloses opening valve 38 to allow the compressor 20 to pump reserve from the evaporator into the receiver.

U.S. Pat. No. 3,400,552 to Johnson et al discloses an electrically controlled refrigerant charging device employing a charge bottle 30. In the event of an overcharge condition, refrigerant is released via bleed valve 33 (column 4, lines 9 to 13).

U.S. Pat. No. 3,903,709 to Anderson et al discloses a refrigerant charging apparatus which automatically delivers incremental quantities of refrigerant from container 12 into the system until a proper level of charge is achieved.

However, none of these references disclose shutting down the compressor and collecting refrigerant which would be released to the atmosphere if it were not collected during a high pressure system failure.

U.S. Pat. Nos. 5,359,863 and 5,361,592 to Lewis disclose method and apparatus for preventing the release of refrigerant to the atmosphere during a high pressure system failure. A tank 34 acts as a receiver for refrigerant from safety relief valve 42 in the event the pressure in the system exceeds the safety relief valve set point. When the refrigerant pressure in receiver tank 34 increases, pressure switch 50 is activated, denying electric current to compressor 5.

U.S. Pat. No. 5,259,204 to McKeown discloses a refrigerant release prevention system adaptable for use with refrigerated containers for shipping food. Recovery tank 20 is connected to the outlet of an existing pressure relief valve 14 or to the outlet of secondary diverter valve 24A. When a system overpressure occurs, pressure switch 32 opens solenoid valve 28 to allow refrigerant to flow to the suction side of the compressor 30.

U.S. Pat. No. 5,408,840 to Talley discloses a refrigerant release prevention system designed for use on automobile air conditioning systems. Recovery tank 20 is connected to the outlet of an existing pressure relief valve via a check valve 32. When a system overpressure occurs, pressure switch 24 disables compressor clutch 80. Recovery tank 20 is equipped with a schrader valve 26 to facilitate removal of the recovered refrigerant at a repair facility (column 4, lines 46 to 48).

U.S. Pat. No. 5,319,945 to Bartlett discloses a system for non-atmospheric venting of refrigerant when evaporator 22 has an overpressure condition. Storage tank 36 is connected via a closed loop, pipes 54 and 56, to the evaporator. When a system overpressure occurs at a pressure less than the relief valve 26 setting, pressure switch 32 sends a signal to controller 34 which in turn shuts down refrigeration system 10. The stored refrigerant can be returned to the system after maintenance is performed.

In refrigeration systems, such as rack systems for frozen or refrigerated foods, which contain a plurality of compressors, it may not be necessary to shut down all of the compressors to prevent the release of refrigerant to the atmosphere. Multiple compressor systems which provide refrigerant to different zones or sections of a unit or space to be cooled may, for example, develop a high pressure problem which affects only one or a few zones or compressors. Accordingly, it may not be necessary to halt the supply of refrigerant and cooling to all zones or sections.

The present invention provides a refrigerant recovery system for multi-compressor refrigeration systems, such as a rack system for foods, which shuts down selected compressors to maintain limited system operation in the event of a system overpressure which causes the safety or relief valve to open and discharge refrigerant. Thus, release of refrigerant to the atmosphere can be avoided while providing cooling or refrigeration to selected or more critical zones requiring cooling. In embodiments of the invention the selected compressors are automatically restarted after a predetermined period of time while feeding the contained refrigerant back into the system. The invention also provides for shutting down the entire multi-compressor system when the system overpressure exceeds the relief valve setpoint by a substantial amount.

The present invention provides a method and apparatus for delivering refrigerant from the high pressure side of a multi-compressor refrigerant system to an evacuated sealed receiver and denying operating current to at least one selected compressor to prevent its or their operation when the high pressure safety valve opens so as to contain refrigerant which would otherwise be discharged into the atmosphere. However, while the one or more compressors are shut down, operating current is continued to be supplied to at least one selected compressor of the multiple compressor system. Thus, operation of the system may be continued when the high pressure safety valve opens while containing refrigerant which would otherwise be discharged into the atmosphere.

SUMMARY OF THE INVENTION

The present invention provides an apparatus and method for preventing the release of refrigerant to the atmosphere during a high pressure safety release situation encountered in a mechanical refrigeration system comprising a plurality of compressors. A refrigerant overpressure receiver tank is connected to the high pressure side of the mechanical refrigeration system for receiving refrigerant during the high pressure safety relief situation. A high pressure safety relief situation occurs when the pressure on the high pressure side exceeds a first predetermined value which is higher than the safe operating pressure of the mechanical refrigeration system. To relieve the excessive refrigerant pressure, normally the refrigerant would be released to the atmosphere through a safety relief valve. In the present invention, the system is relieved of the pressure by releasing the refrigerant into the refrigerant overpressure receiver tank rather than into the atmosphere. In the event the system overpressure condition is severe enough to raise the system pressure a substantial amount over the first predetermined value, a secondary safety relief system relieves the pressure by releasing additional refrigerant into the refrigerant overpressure receiver tank rather than into the atmosphere.

Further operation of at least one of the multiple compressors in the mechanical refrigeration system is prevented when the pressure in the overpressure receiver tank exceeds a second predetermined value. The second predetermined value is substantially lower than the safe operating pressure of the high pressure side of the mechanical refrigeration unit. Thus, the pressure on the high pressure side is relieved by release of refrigerant to the receiver tank and the system is partially shut down so as to reduce the overall pressure in the system without release of refrigerant to the atmosphere.

The partial shutdown of the multiple compressor system is achieved as a result of at least one compressor in the mechanical refrigeration system continuing to operate while at least one of the compressors is shut down. Thus, the system can operate in a partial shutdown mode while simultaneously preventing the release of refrigerant to the atmosphere. Furthermore, the system can be designed so that more critical refrigeration loads are still maintained in a cooled state while the system operates in the partial shut down mode. Less critical cooling loads are designed to correspond to the individual compressor/evaporator systems that are shut down while the system is in a partial shut down mode. For example, a computer room could be maintained cool while less critical office space is allowed to heat up. Also, for an evaporator rack system wherein each compressor corresponds to at least one evaporator, the compressor/evaporator systems cooling the most expensive or valuable food products can be maintained cool or frozen by having their designated compressors continue to operate. The less expensive food products are allowed to go without cooling until the system can be restored or repaired. In this manner, the invention provides a method and apparatus to maintain a limited ability to cool or freeze while lessening the damage resulting from a system overpressure.

The present invention is especially useful for multi-compressor systems having rack evaporators, such as those used in grocery stores for storing and displaying frozen food products. Often, pressure spikes occur in such a system because, for example, a condenser fan in the system does not activate quickly enough. The present invention provides an alternative to the risk of having a faulty conventional relief valve discharge the entire refrigerant charge, allowing all the frozen food to spoil.

In embodiments of the present invention, the overpressure receiver tank is connected to the high pressure side via the existing high pressure safety relief valve or blow-out valve of the mechanical refrigeration system.

The receiver tank may have a capacity which is sufficient to contain at least 5% by weight, preferably from about 10% by weight to about 18% by weight of the refrigerant capacity of the mechanical refrigeration system. In embodiments of the invention, the overpressure receiver tank receives refrigerant from the high pressure gaseous or vapor side of the mechanical refrigeration system when the system pressure exceeds a first predetermined value and the safety or relief valve releases refrigerant. In the event the system overpressure condition is severe enough to raise the system pressure a substantial amount over the first predetermined value, a secondary safety relief system relieves the pressure by releasing additional refrigerant into the refrigerant overpressure receiver tank via a refrigerant conduit connected to the high pressure liquid side of the mechanical refrigeration system.

Under normal operating conditions, flow of refrigerant to the overpressure receiver tank is prevented, and the refrigerant pressure in the overpressure receiver tank is preferably less than about 1 psig, more preferably about atmospheric pressure. In embodiments of the invention, when a safety relief situation occurs, refrigerant pressure on the high pressure side may exceed the set point or blow-off pressure on a pressure relief valve. The set point may, for example, be 200 psig, 300 psig, 400 psig or higher. The excessive pressure causes the relief valve to open, thereby permitting flow of refrigerant from the high pressure side through a refrigerant conduit and into the overpressure receiver tank. The flow of refrigerant into the overpressure receiver tank causes the pressure in the tank to increase. When the pressure in the overpressure receiver tank exceeds a predetermined value which may be less than about 50 psig, preferably less than or equal to about 40 psig, further operation of at least one of the plurality of compressors in the system is prevented.

Preventing the operation may be achieved by means of a pressure switch which is attached to the overpressure receiver tank. Activation of the switch when the pressure in the receiving tank exceeds a predetermined pressure results in the denial or cutting off of operating current to at least one of the plurality of compressors. In addition to cutting line voltage to the compressor, current to the fans and other electrical devices operatively connected to the compressor may be cut off, if desired.

In other embodiments of the invention, the system automatically attempts to restart the compressor or compressors that were disabled after the overpressure event. After about one hour or less, preferably about 30 minutes, the system attempts to recharge back into the system the refrigerant released from the safety valve and contained in the overpressure receiver tank. A recharging device, located in a refrigerant conduit connecting the overpressure receiver tank and the low pressure side of the refrigerant loop, opens and provides a recharging flow of refrigerant to the low pressure side of the refrigerant loop. The refrigerant is fed back into the system at a single point or more preferably at several points, located near the suction line of each compressor in the system. Preferably, the recharge device is a solenoid valve. After the recharge valve has opened and the refrigerant has been recharged back into the system, the pressure in the overpressure receiver tank drops below the set point for the pressure switch on the overpressure tank, and the pressure switch de-activates, allowing the compressor or compressors that were shut down in response to the overpressure event to restart.

If the overpressure event repeats itself, the entire sequence described above comprising refrigerant containment and recharge, and compressor shutdown and startup will repeat itself.

If, however, the refrigerant system is malfunctioning to the extent that the system overpressure exceeds the main relief valve setting by a substantial amount, a secondary safety relief valve relieves the pressure by releasing additional refrigerant into the refrigerant overpressure receiver tank via another refrigerant conduit. The secondary relief valve is set to open at a pressure substantially higher than the primary relief valve set point, for example from about 10 psi to about 40 psi higher. A second pressure switch, connected to the secondary relief conduit, senses the pressure resulting from the opening of the secondary relief valve, and shuts down every compressor in the multi-compressor system.

The refrigerant conservation system of the present invention may be used for preventing the release of refrigerant to the atmosphere from any mechanical refrigeration system employing more than one compressor.

DETAILED DESCRIPTION OF THE INVENTION

The present invention provides a refrigerant conservation system and method for preventing the release of refrigerant to the atmosphere from a mechanical refrigeration system having multiple compressors during a high pressure safety relief situation or high pressure failure. The refrigerant conservation system and method are applicable to existing multi-compressor refrigeration systems as well as to new installations. Mechanical refrigeration includes those processes in which the refrigerant is recovered and recirculated. In a vapor-compression system, a compression machine is used which may have either a positive-displacement mechanism (reciprocating or rotary compressor) or an impeller (centrifugal compressor). In the present invention, refrigerant which would normally be released to the atmosphere is collected in a refrigerant overpressure receiver tank. The resulting increase in pressure in the overpressure receiver tank activates an electrical switch which denies operating current to at least one of the compressors of the mechanical refrigeration system so that system pressure may be reduced while allowing operation of at least one compressor. The activation of the switch may also be used to deny operating current to fans, motors, and other electrical equipment operatively connected to the compressor or compressors which are shut down.

Exemplary mechanical refrigeration systems which may be modified or retrofitted to conserve refrigerant in accordance with the present invention include any system having at least two compressors. Refrigerants which may be conserved in accordance with the present invention include all man-made refrigerants such as Freon® 12, Freon® 22, Freon® 500 or other CFC's, HFC **134*a*** and HCFC 123.

Figure 1:
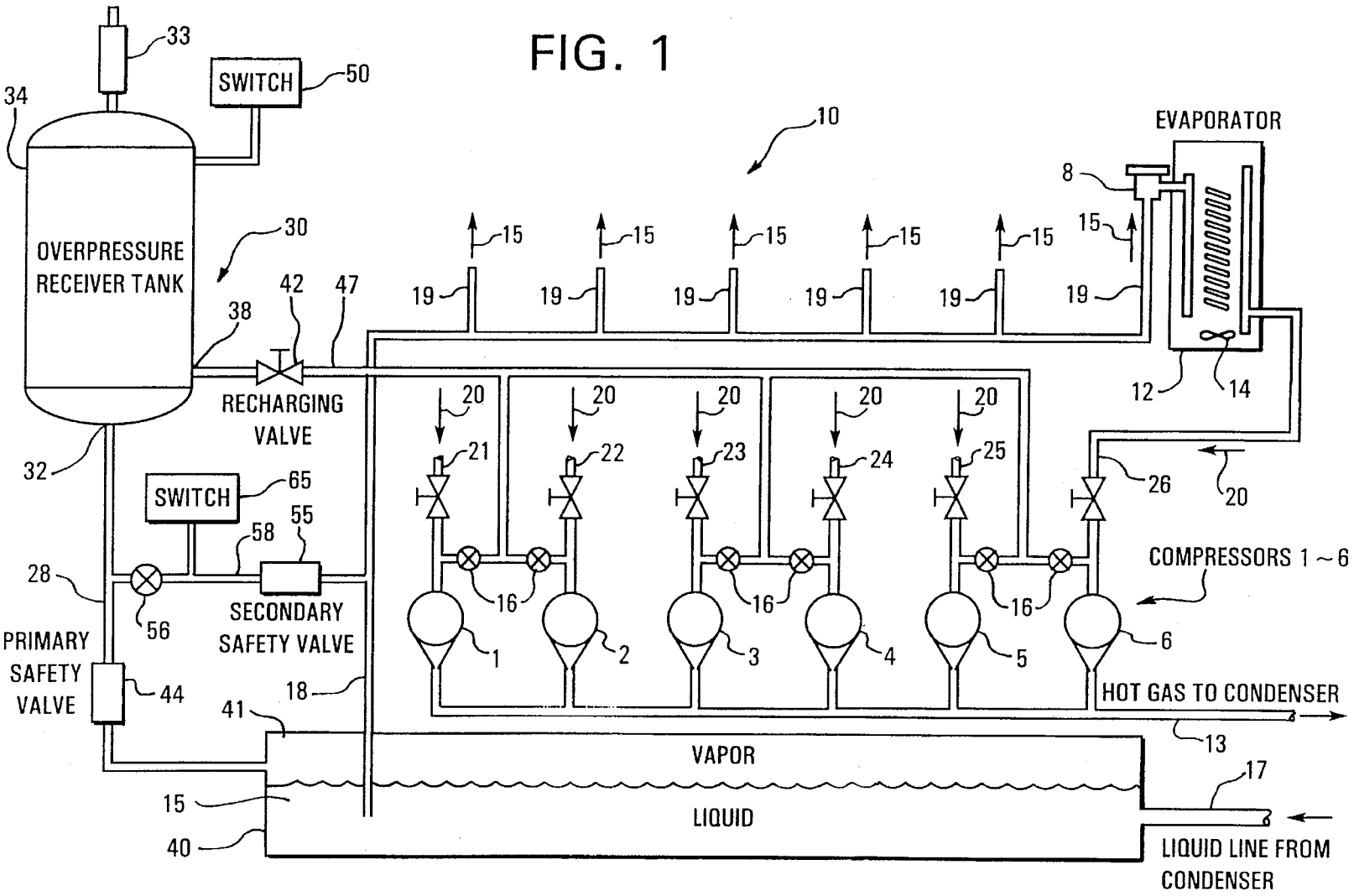
FIG. 1 is a schematic showing a safety relief refrigerant conservation system in accordance with the present invention.

As shown in FIG. 1, a multi-compressor mechanical refrigeration system 10 comprises a closed loop system. In FIG. 1 six compressors are shown, however, any number of compressors greater than one may be controlled by the system. The four primary components in the closed loop system are the compressors 1–6, a condenser (not shown), and at least one expansion valve 8 and evaporator 12 for each of compressors 1–6. In FIG. 1, only the expansion valve and evaporator corresponding to compressor 6 are shown. Each of compressors 1–5 may also have at least one evaporator associated with it. In operation, a fluorocarbon refrigerant flows through the closed loop system. The refrigerant is compressed from a low pressure gaseous state to a high pressure gaseous state by the compressors 1–6. Refrigerant leaves the compressors 1–6, and flows via line 13 into the condenser. The condenser serves as a heat exchanger, and is functionally similar to an automobile radiator in that it removes heat from the closed loop system via forced air convection, when a condenser fan is used. A water tower or a well can also function as a condenser. By whatever means, heat is removed from the condenser to thereby facilitate the condensation of the compressed refrigerant vapor into a cooled, liquefied refrigerant. The cooled, liquefied refrigerant 15 then flows via return line 17 into receiver 40. The cooled liquefied refrigerant 15 is then transferred from receiver 40 via liquid supply line 18 and evaporator supply lines 19 through each expansion valve 8 (only one of six shown). Expansion valve 8 regulates the flow of refrigerant into the evaporator 12 (only one of six shown). During the evaporation process, the refrigerant expands into its gaseous state, absorbing heat in the process.

The refrigerant then passes through evaporator 12. Evaporator 12 also serves primarily as a heat exchanger, and may have a finned tube construction or a rack type construction suitable for use with frozen food. As shown in FIG. 1, a fan 14 draws air through evaporator 12. The contact of the air and the evaporator 12 cools the air. This cooled air can then be transported by appropriate ducts into the space to be cooled, such as the interior of the building, house, or a refrigerator or freezer unit or zones or sections thereof. Low pressure refrigerant vapor 20 is returned to the compressors 1–6 via the low pressure side and suction lines 21–26, corresponding to each compressor 1–6, respectively.

The multi-compressor mechanical refrigeration system 10 may include a high pressure port (not shown) disposed downstream from the compressors 1–6, and a low pressure port (not shown) disposed upstream from the compressors 1–6. Refrigerant can be introduced into, and removed from the multi-compressor mechanical refrigeration system 10 through the high pressure port and low pressure port. The high pressure port typically includes a coupling member to which a line can be coupled to introduce refrigerant to, or remove refrigerant from the high pressure port. The low pressure port also includes a similar coupling member.

The refrigerant recovery system 30 includes a primary refrigerant relief conduit 28 that extends between the high pressure vapor or gas portion 41 of the receiver 40, and the inlet port 32 of the overpressure receiver or storage tank 34. The overpressure receiver tank 34 may be a conventional type used in refrigeration systems, such as those approved by ASHRAE, OSHA or Underwriter's Lab. The overpressure receiver tank 34 includes an outlet 38 connected to a recharging valve 42 for recharging refrigerant into the low pressure side of the mechanical refrigeration system 10 via line 47.

In embodiments of the present invention, the refrigerant overpressure receiver tank 34 may be connected via its inlet 32 to the high pressure gaseous side of the mechanical refrigeration system 10 at the upper vapor portion of receiver 40 by means of a primary refrigerant relief conduit 28 and an existing primary safety valve or blow out valve 44. The primary safety valve 44 is placed in fluid communication with the high pressure side of the mechanical refrigeration system and with the overpressure receiver tank 34. The primary safety valve 44 prevents the flow of refrigerant to the overpressure receiver tank 34 unless the pressure on the high pressure side exceeds a first predetermined value which is higher than the safe operating pressure of the high pressure side of the mechanical refrigeration system.

As shown in FIG. 1, the overpressure receiver tank 34 may be connected via the refrigerant conduit 28 to an existing or pre-installed primary safety or blow out valve 44. In retro-fitting existing refrigeration systems, this is a preferred connection provided that sufficient space is available for making the connections. The safety relief or blow out valve 44 is preferably resettable. Existing non-resettable valves, such as safety plugs are preferably replaced with a resettable safety valve.

The safe operating pressure of the high pressure side of the multi-compressor mechanical refrigeration system 10 will depend upon the particular size and design of the unit as well as the type of refrigerant used. Safe operating pressures may, for example, range up to about 500 psig. A primary safety valve or blow out valve 44 may, for example, be set to open when the pressure on the high pressure side exceeds 200 psig, 300 psig, 400 psig, or the like. In any event, when the pressure on the high pressure side exceeds a first predetermined value which is higher than the safe operating pressure of the high pressure side, the primary safety or blow out valve 44 opens and permits flow of refrigerant via the primary refrigerant relief conduit 28 into the overpressure receiver tank 34. Prior to permitting flow of refrigerant to the overpressure receiver tank 34 in the pressure relief situation, the overpressure receiver tank 34 is preferably evacuated and charged with refrigerant to a pressure of up to about atmospheric pressure. The overpressure receiver tank 34 may be charged to a pressure higher than atmospheric but it decreases its surge capacity. The overpressure receiver tank 34 may have a capacity which is sufficient to contain at least about 5% by weight, preferably from about 10% by weight to about 18% by weight of the refrigerant capacity of the multi-compressor mechanical refrigeration system 10. In embodiments of the invention, the overpressure receiver tank 34 may be jacketed. The jacket may be supplied with a coolant or refrigerant to condense or liquefy refrigerant vapor flowing into the tank 34 and thereby increase its surge capacity.

As the overpressure receiver tank 34 receives refrigerant under a high pressure safety relief situation, the pressure in the overpressure receiver tank 34 increases. When the pressure in the overpressure receiver tank 34 exceeds a predetermined value which is substantially lower than the safe operating pressure of the high pressure side, a first pressure switch 50 which is attached to the overpressure receiver tank 34 is activated. First pressure switch 50 may also be installed on primary refrigerant relief conduit 28 at a location downstream of primary safety valve 44. Activation may be set to occur at less than about 50 psig, preferably less than or equal to about 40 psig, depending upon the type of refrigerant used and the system operating pressure. Activation is set to occur above the normal charging pressure of the overpressure receiving tank 34. The first pressure switch 50 may also be connected to the outlet 38 of the overpressure receiver tank 34 by means of a service refrigerant line which may be used to evacuate or charge refrigerant into the overpressure receiver tank 34.

Figure 2:
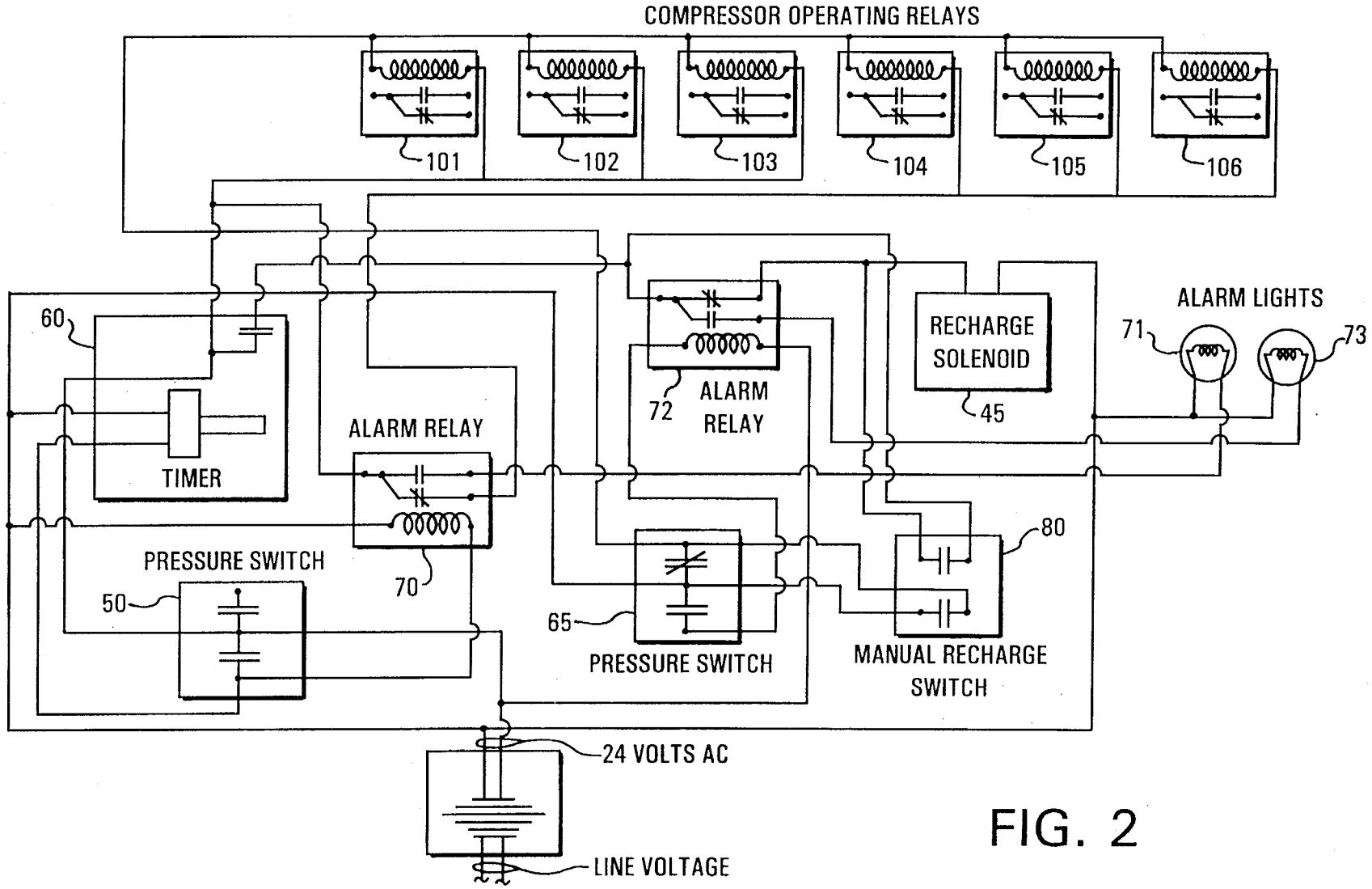
FIG. 2 is a schematic electrical wiring diagram which may be used with the safety relief refrigerant conservation system of the present invention.

As illustrated in FIG. 2, upon activation of first pressure switch 50 by the rising pressure in the overpressure receiver tank 34, normally open contacts close inside the first pressure switch 50. These contacts operate the timer 60 and the first alarm relay 70. This causes the normally closed contacts in the first alarm relay 70 to open. This in turn causes a first alarm light 71 to energize, giving a visual indication of the overpressure condition in the system. This also causes compressor operating relays 104, 105 and 106 to open, denying operating current to compressors 4, 5 and 6 respectively.

It should be noted that the present invention provides for any number or combination of compressors being shut down, so long as at least one compressor continues to operate.

Thus, compressors 4, 5 and 6 are shut down, and the mechanical refrigeration system 10 will continue to operate in a partial shutdown mode until a predetermined time period elapses. The predetermined time period is usually about one hour or less, preferably about 30 minutes. After this predetermined time period is over, the timer 60 activates the recharge solenoid 45 which opens the recharging valve 42, which is preferably a solenoid valve, so that the refrigerant contained in the overpressure receiver tank 34 is recharged back into the system. Recharging valve 42 is located in refrigerant recharging conduit 47 connecting the overpressure receiver tank 34 and the low pressure side of the refrigerant loop. Preferably, check valves 16 are located at any point where the refrigerant recharging conduit 47 connects to the low pressure side of the system, to permit flow only from the overpressure receiver tank 34 into the low pressure side and to isolate conduit 47 from pressure backflow coming from non-operating compressors. Recharging valve 42 opens and provides a recharging flow of refrigerant to the low pressure side of at least one of the compressors which are still operating. The recharging flow is preferably supplied at a point each located near each of the suction lines 21–26. After the recharging valve 42 has opened and the refrigerant has been fed back into the system, the pressure in the overpressure receiver tank drops below the set point for the first pressure switch 50 on the overpressure receiver tank 34, and the contacts in first pressure switch 50 re-open. This denies current to the timer 60, which resets at the start position. This also denies current to the first alarm relay 70. Without current, the contacts in first alarm relay 70 are closed, which in turn allows the contacts in compressor relays 104, 105 and 106 to close. Thus, operating current is restored and compressors 4, 5 and 6 return to operation. At this point, the overpressure has been contained and has not resulted in a refrigerant release, and all compressors have automatically been returned to normal operation. In preferred embodiments, refrigerant has been provided to cool more expensive or critical items or zones without interruption throughout the entire overpressure event. The entire sequence will automatically repeat itself if the system pressure rises again and refrigerant is released from primary safety valve 44.

If, however, the multi-compressor mechanical refrigeration system 10 is malfunctioning to the extent that the system overpressure exceeds the primary safety valve 44 setting by a substantial amount, a secondary safety valve 55, preferably a diaphragm valve, opens and relieves the pressure by releasing refrigerant into the overpressure receiver tank 34 via secondary refrigerant relief conduit 58. This additional or secondary refrigerant relief conduit 58 is preferably connected to the high pressure liquid side of the multi-compressor mechanical refrigeration system 10. The secondary safety valve 55 is set to open at a pressure substantially higher than the primary relief valve 44 set point, for example 10 psi to 40 psi higher. In a preferred embodiment the secondary safety valve 55 set point is about 25 psi higher than the primary safety valve 44 set point. For example, the primary safety valve could be set at 400 psi and the secondary safety valve could be set at 425 psi. A second pressure switch 65 is in fluid communication with the secondary refrigerant relief conduit 58. Second pressure switch 65 is set to open at about 60 psi or less, more preferably 50 psi or less, depending upon the operating pressure of the system and the type of refrigerant used. The second pressure switch 65 must be isolated from refrigerant pressure until the secondary safety valve 55 opens, so means to isolate the secondary refrigerant relief conduit 58 at its downstream end from either the overpressure receiver tank 34 or the primary refrigerant relief conduit 28 are provided. Preferably the isolation means 56 comprises a check valve. Isolation means 56 serves two purposes, proper operation of the system, i.e. second pressure switch 65, as well as keeping back pressure off of secondary safety valve 55, which could lower its effective set point if it is a diaphragm valve. When the secondary safety valve 55 opens, normally closed contacts in second pressure switch 65 open. This in turn denies current to the entire common side of compressor operating relays 101, 102, 103, 104, 105 and 106 for compressors 1–6, respectively. Thus, the entire multi-compressor system is effectively shutdown. Second alarm relay 72 opens and denies current to recharge solenoid 45 as well as providing a visual indication of the system status via second alarm light 73. External alarms can also be provided for both alarm functions.

At this point, the multi-compressor mechanical refrigeration system 10 requires the attention of a certified refrigerant repair technician. After the cause of the overpressure condition has been repaired, the technician operates manual recharge switch 80 which allows refrigerant to flow from the overpressure receiver tank 34 into the system via outlet 38 and 47. All pressure controls return to normal and the system is operational.

As shown in FIG. 1, the refrigerant conservation system 30 of the present invention may include a further safety relief valve 33 on the overpressure receiver tank 34. The further safety relief valve or blow out valve 33 is arranged so that it does not prevent the collection of refrigerant to the overpressure receiver tank 34 but permits release of the refrigerant to the atmosphere if the pressure in the overpressure receiver tank 34 exceeds a predetermined value. This predetermined value may equal the set point of primary relief valve 44 or it may be substantially higher.

It should be understood that the controls may be DC control circuits, low voltage AC control circuits, solid state control circuits and the like. Pneumatic controls may also be used. Operating current may be similarly denied to fans, motors, and other electrical components operatively connected to the system or its components such as the compressors, evaporators, and condensors.

What is claimed is:

1. A system for preventing the release of refrigerant to the atmosphere from a mechanical refrigeration system having a plurality of compressors, comprising:

a refrigerant overpressure receiver tank, a primary refrigerant relief conduit in fluid communication with said overpressure receiver tank and with a high pressure side of a refrigerant loop of the mechanical refrigeration system, a primary safety relief device in said primary refrigerant relief conduit comprising means for preventing flow of refrigerant to the overpressure receiver tank unless the pressure on said high pressure side of the refrigerant loop exceeds a first predetermined value which is higher than the safe operating pressure of said high pressure side of the refrigerant loop, a first pressure switch actuated by an increase in pressure in said overpressure receiver tank for preventing further operation of at least one of said plurality of compressors in the mechanical refrigeration system when the pressure in said overpressure receiver tank exceeds a second predetermined value which is substantially lower than said safe operating pressure, whereby at least one of said plurality of compressors in the mechanical refrigeration system continues to operate.

2. A system for preventing the release of refrigerant to the atmosphere as claimed in claim 1, further comprising:

a refrigerant recharging conduit in fluid communication with said overpressure receiver tank and with a low pressure side of the refrigerant loop, a recharging device in said refrigerant recharging conduit for providing a recharging flow of refrigerant to said low pressure side of the refrigerant loop from said over pressure receiver tank after a predetermined period of time, and a timing device for measuring said predetermined amount of time, said timing device being operatively connected to said recharging device for initiating said recharging and being operatively connected for restarting said compressors which have been prevented from operating by said first pressure switch.

3. A system for preventing the release of refrigerant to the atmosphere as claimed in claim 1, further comprising:

a secondary refrigerant relief conduit in fluid communication with said overpressure receiver tank and with the high pressure side of said refrigerant loop, a second safety relief device in said secondary refrigerant relief conduit comprising means for preventing flow of refrigerant through said secondary refrigerant relief conduit and into the overpressure receiver tank unless the pressure on the high pressure side of said refrigerant loop exceeds a third predetermined value which substantially exceeds said first predetermined value, a second pressure switch in fluid communication with said secondary refrigerant relief conduit for preventing further operation of all of said plurality of compressors in the mechanical refrigeration system in the event said secondary refrigerant relief conduit is pressurized by the opening of said second safety relief device, and means for preventing refrigerant in said overpressure receiver tank from flowing into said secondary refrigerant relief conduit.

4. A system for preventing the release of refrigerant to the atmosphere as claimed in claim 1 wherein said overpressure receiver tank has a capacity which is sufficient to contain at least about 5% by weight of the refrigerant capacity of the mechanical refrigeration system.

5. A system for preventing the release of refrigerant to the atmosphere as claimed in claim 1 further comprising at least one evaporator for cooling zones corresponding to each compressor in the mechanical refrigeration system, wherein the evaporators corresponding to the compressors which have been prevented from operating cool different zones than the evaporators corresponding to the compressors which continue to operate, whereby at least one zone continues to be cooled when the mechanical refrigeration system is in a partial shutdown mode.

6. A system for preventing the release of refrigerant to the atmosphere as claimed in claim 2 wherein said timing device is electrically connected to the recharging device via a solenoid, said predetermined period of time being from about 30 minutes to about one hour.

7. A system for preventing the release of refrigerant to the atmosphere as claimed in claim 3 wherein said third predetermined value exceeds said first predetermined value by at least about 25 psi.

8. A system for preventing the release of refrigerant to the atmosphere as claimed in claim 3 wherein said primary refrigerant relief conduit is in fluid communication with a high pressure gaseous or vapor side of the mechanical refrigeration system and wherein said secondary refrigerant relief conduit is in fluid communication with a high pressure liquid side of the mechanical refrigeration system.

9. A system for preventing the release of refrigerant to the atmosphere as claimed in claim 8 wherein said second safety relief device comprises a diaphragm valve.

10. A system for preventing the release of refrigerant to the atmosphere as claimed in claim 2 wherein said recharging device further comprises means for providing a recharging flow of refrigerant to said low pressure side of the refrigerant loop upon activation of a manual switch.

11. A system for preventing the release of refrigerant to the atmosphere as claimed in claim 2 wherein said refrigerant recharging conduit further comprises means for preventing refrigerant in said low pressure side of the refrigerant loop from flowing into said refrigerant recharging conduit.

12. A method for preventing the release of refrigerant to the atmosphere from a mechanical refrigeration system having a plurality of compressors, comprising:

providing a refrigerant overpressure receiver tank for receiving refrigerant from a high pressure side of the mechanical refrigeration system, preventing a first overpressure flow of refrigerant to the receiver tank unless the pressure on said high pressure side of the refrigerant loop exceeds a first predetermined value which is higher than the safe operating pressure of said high pressure side of the refrigerant loop, collecting refrigerant from said high pressure side in the overpressure receiver tank when the pressure on said high pressure side exceeds said first predetermined value, preventing further operation of at least one but not all of said plurality of compressors in the mechanical refrigeration system when the pressure in said overpressure receiver tank exceeds a second predetermined value which is substantially lower than said safe operating pressure, and continuing the operation of at least one of said plurality of compressors in the mechanical refrigeration system while said further operation of at least one compressor is prevented.

13. A method for preventing the release of refrigerant to the atmosphere as claimed in claim 12, further comprising:

storing said collected refrigerant in said overpressure receiver tank for a predetermined period of time, recharging said collected refrigerant from the receiver tank into a low pressure side of the refrigerant loop after said predetermined period of time has elapsed, and restarting said at least one of the plurality of compressors which have been prevented from operating when the pressure in said receiver tank is lower than said second predetermined value.

14. A method for preventing the release of refrigerant to the atmosphere as claimed in claim 13, further comprising:

preventing a second overpressure flow of refrigerant to the receiver tank unless the pressure on the high pressure side of said refrigerant loop exceeds a third predetermined value which substantially exceeds said first predetermined value, and preventing further operation of all of said plurality of compressors in the mechanical refrigeration system in the event the pressure on the high pressure side of said refrigerant loop exceeds said third predetermined value.

15. A method for preventing the release of refrigerant to the atmosphere as claimed in claim 14 wherein said overpressure receiver tank is filled to contain at least about 5% by weight of the refrigerant capacity of the mechanical refrigeration system.

16. A method for preventing the release of refrigerant to the atmosphere as claimed in claim 12 wherein said at least one of the plurality of compressors which have been shut down are for cooling at least one zone of a food refrigeration unit different than at least one zone cooled by said at least one of the plurality of compressors which continue to operate, whereby at least one zone of food products continue to be cooled when the mechanical refrigeration system is in a partial shutdown mode.

17. A method for preventing the release of refrigerant to the atmosphere as claimed in claim 13 wherein said predetermined period of time is from about 30 minutes to about one hour.

18. A method for preventing the release of refrigerant to the atmosphere as claimed in claim 14 wherein said third predetermined value exceeds said first predetermined value by at least about 25 psi.

19. A method for preventing the release of refrigerant to the atmosphere as claimed in claim 14 wherein after flow of refrigerant to the overpressure receiver tank, refrigerant is released to the atmosphere if the pressure in the receiver tank is equal to or greater than said third predetermined value.

20. A method for preventing the release of refrigerant to the atmosphere as claimed in claim 14 wherein said first overpressure refrigerant flow originates in a high pressure gaseous or vapor side of the mechanical refrigeration system and wherein said second overpressure refrigerant flow originates in a high pressure liquid side of the mechanical refrigeration system.

* * * * *